United States Patent [19]

Hasegawa et al.

[11] Patent Number: 4,872,858

[45] Date of Patent: Oct. 10, 1989

[54] OUTBOARD JET PROPULSION DEVICE

[75] Inventors: Junichi Hasegawa; Hideharu Takahashi, both of Hamamatsu, Japan

[73] Assignee: Sanshin Kogyo Kabushiki Kaisha, Hamamatsu, Japan

[21] Appl. No.: 164,242

[22] Filed: Mar. 4, 1988

[30] Foreign Application Priority Data

Mar. 5, 1987 [JP] Japan ..... 62-48717

[51] Int. Cl.[4] ..... B63H 11/08

[52] U.S. Cl. ..... 440/38; 440/47

[58] Field of Search ..... 440/38, 40–43, 440/46, 47, 66; 60/221, 222

[56] References Cited

U.S. PATENT DOCUMENTS 2,743,698 5/1956 Leonard et al. ..... 440/40

3,082,732 3/1963 Stallman ..... 440/42 X

*Primary Examiner*—Sherman D. Basinger

*Attorney, Agent, or Firm*—Ernest A. Beutler

[57] ABSTRACT

A jet propelled outboard drive including an improved streamlining housing arrangement for streamlining the flow in proximity to the area where the water inlet joins the impeller cavity.

3 Claims, 5 Drawing Sheets

OUTBOARD JET PROPULSION DEVICE

BACKGROUND OF THE INVENTION

This invention relates to an outboard jet propulsion device and more particularly to an improved lower housing construction for such a device.

Many forms of outboard drives employ jet propulsion units for propelling the watercraft through the water. Such units include a vertically extending impeller shaft that rotates within a cylindrical cavity and which draws water through a downwardly and partially forwardly facing water inlet. Generally, the construction of the outer housing is such that the cavity is defined by a cylindrical portion and the water inlet is defined by a foot shaped portion.

FIGS. 1 and 2 show in side elevation and top plan the configuration of the conventional lower unit of such jet propulsion outboard drives. As seen in these figures, the lower unit housing has a generally cylindrical portion 21 that defines the impeller cavity in which the impeller is contained. A downwardly facing water inlet 22 is defined by a foot like portion 23 and which water inlet faces somewhat in a forward direction. It will be noted that there is a discontinuity in configuration between the foot like portion 23 that defines the inlet 22 and the cylindrical portion 21. As a result, the water flow as the watercraft travels through the water will be deflected back forwardly as shown by the arrow in FIG. 1 and add to the flow resistance. As a result, this type of unit consumes more power than is desirable for efficient operation.

It is, therefore, a principal object of this invention to provide an improved lower unit arrangement for a jet propulsion outboard drive.

It is a further object of this invention to provide an improved streamlining arrangement for the lower unit of a jet propelled outboard drive.

SUMMARY OF THE INVENTION

This invention is adapted to be embodied in a jet propulsion unit for an outboard drive that is comprised of a lower unit housing which journals an impeller shaft for rotation about a vertically extending axis. An impeller is contained within a generally cylindrical cavity in the lower unit housing and is driven by the impeller shaft. An inlet portion depends from the cylindrical cavity and extends forwardly therefrom. A volute chamber is formed above the cylindrical cavity and forms a rearwardly directed water outlet. In accordance with the invention, a forwardly extending flow diverting member extends forwardly of the cylindrical cavity and terminates forwardly in proximity to the forward end of the inlet portion.

DETAILED DESCRIPTION OF THE PREFERRED EMBODIMENT

Figure 1:
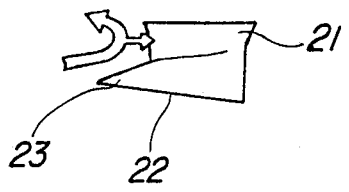
Fig-1 PRIOR ART
FIG. 1 is a side elevational view of a jet propulsion unit constructed in accordance with the prior art.
Figure 2:
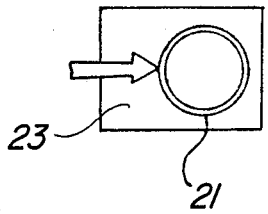
Fig-2 PRIOR ART
FIG. 2 is a top plan view of the prior art jet propulsion unit.
Figure 3:
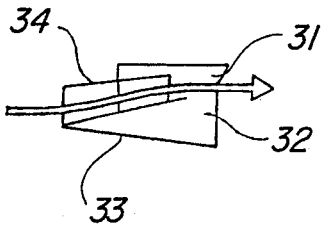
FIG. 3 is a side elevational view showing the principle of this invention in comparison to the corresponding configuration of the prior art construction as shown in FIG. 1.
Figure 4:
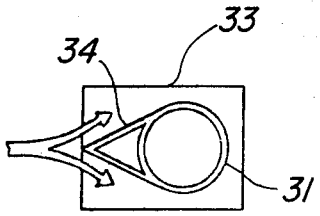
FIG. 4 is a top plan view showing the principle of the invention in comparison to the top plan view of the prior art construction as shown in FIG. 2.
Figure 8:
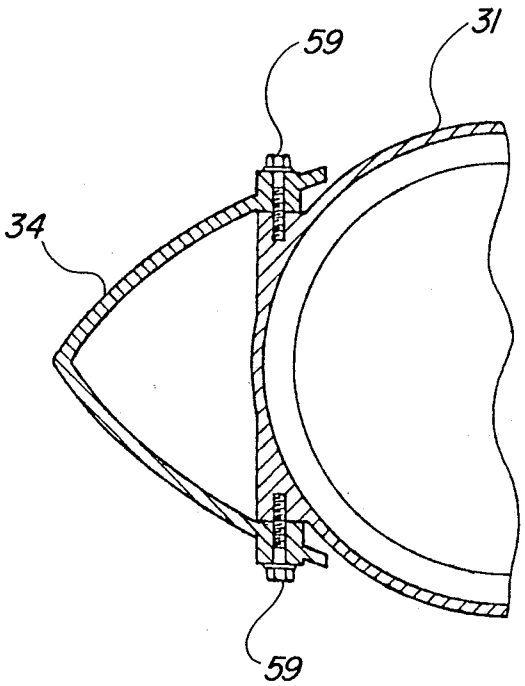
FIG. 8 is a cross-sectional view taken along the line 8—8 of FIG. 7.

The principle of the invention can be understood by reference to FIGS. 3 and 4 wherein a cylindrical housing part of a lower unit constructed in accordance with an embodiment of the invention is identified generally by the reference numeral 31. The cylindrical part 31 is formed above a generally foot shaped water inlet portion 32 that defines a downwardly facing water inlet 33. It will be noted that the foot portion 33 extends forwardly of the cylindrical part 31. In accordance with the invention, a generally V shaped water deflector 34 is affixed to the cylindrical part 31 and extends forwardly from it so as to define a flow directing or diverting member that begins at the forward edge of the foot 33 and extends rearwardly therefrom. As a result, water flow as the lower unit passes through the water will be in a streamline fashion as shown by the arrows in FIGS. 3 and 4.

Figure 5:
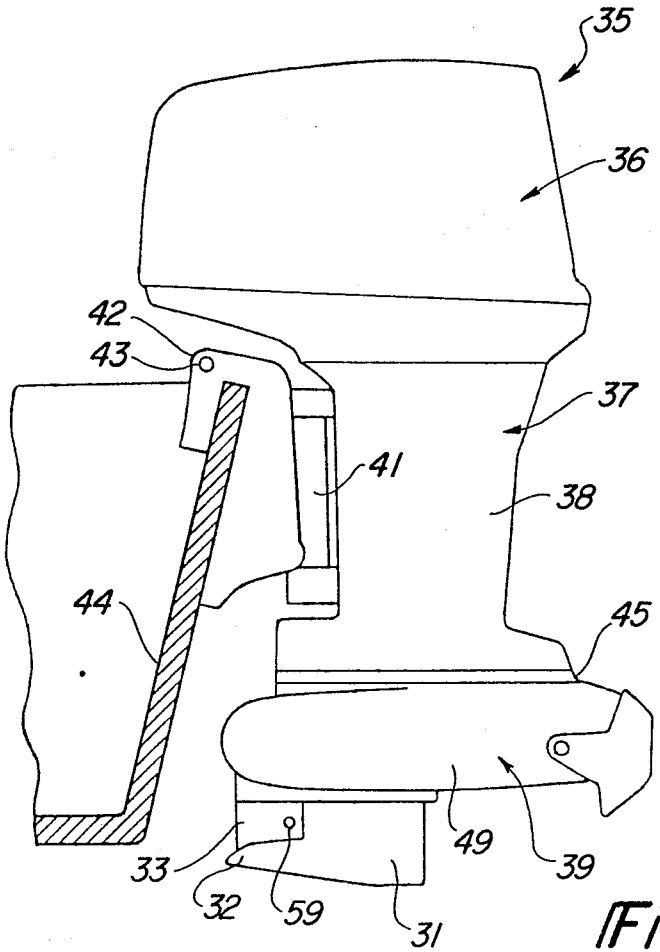
FIG. 5 is a side elevational view of an outboard motor constructed in accordance with an embodiment of the invention as attached to the transom of an associated watercraft, which is shown partially and in section.

Referring now in detail to the remaining figures and initially to FIG. 5, an outboard motor constructed in accordance with the embodiment of the invention is identified generally by the reference numeral 35. The invention is particularly adapted for use with outboard drives such as the outboard drive portion of an inboard, outboard drive or an outboard motor per se as illustrated. The outboard motor 35 is comprised of a power head 36 that contains a powering internal combustion engine (not shown). The engine drives a drive shaft that is journaled within a drive shaft housing, indicated generally by the reference numeral 37 and comprised of an outer housing 38. A lower unit 39 contains a jet drive unit, to be described, which is driven by the drive shaft that is journaled within the drive shaft housing 37.

A swivel bracket 41 is affixed to the drive shaft housing 37 in a known manner and is connected to a clamping bracket 42 by means of a pivot pin 43 for tilting of the outboard motor 31 about the horizontally extending pivot axis defined by the pivot pin 43. The clamping bracket 42 forms a means of attachment of the outboard motor 35 to a transom 44 of an associated watercraft in a known manner.

Figure 6:
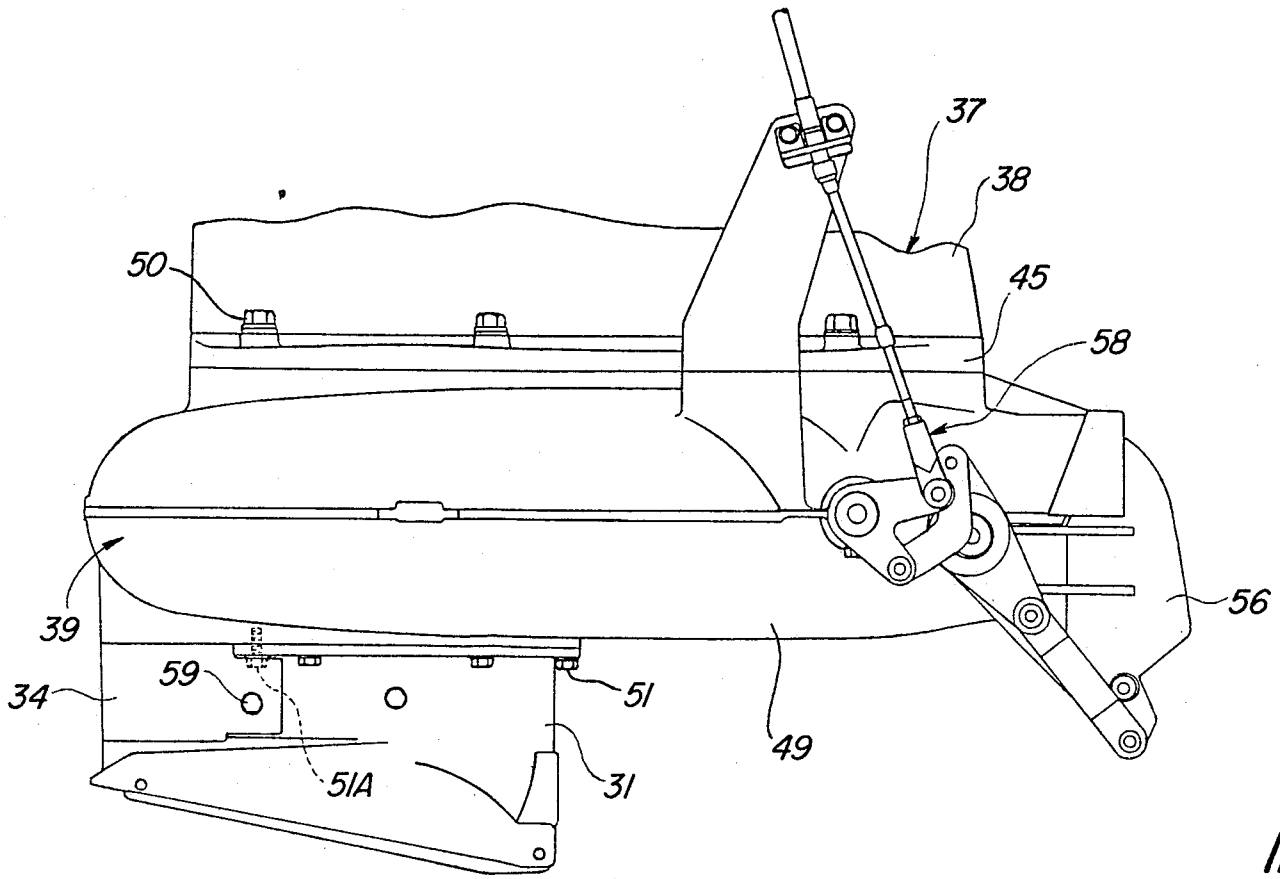
FIG. 6 is an enlarged side elevational view of the lower unit of the outboard drive.
Figure 7:
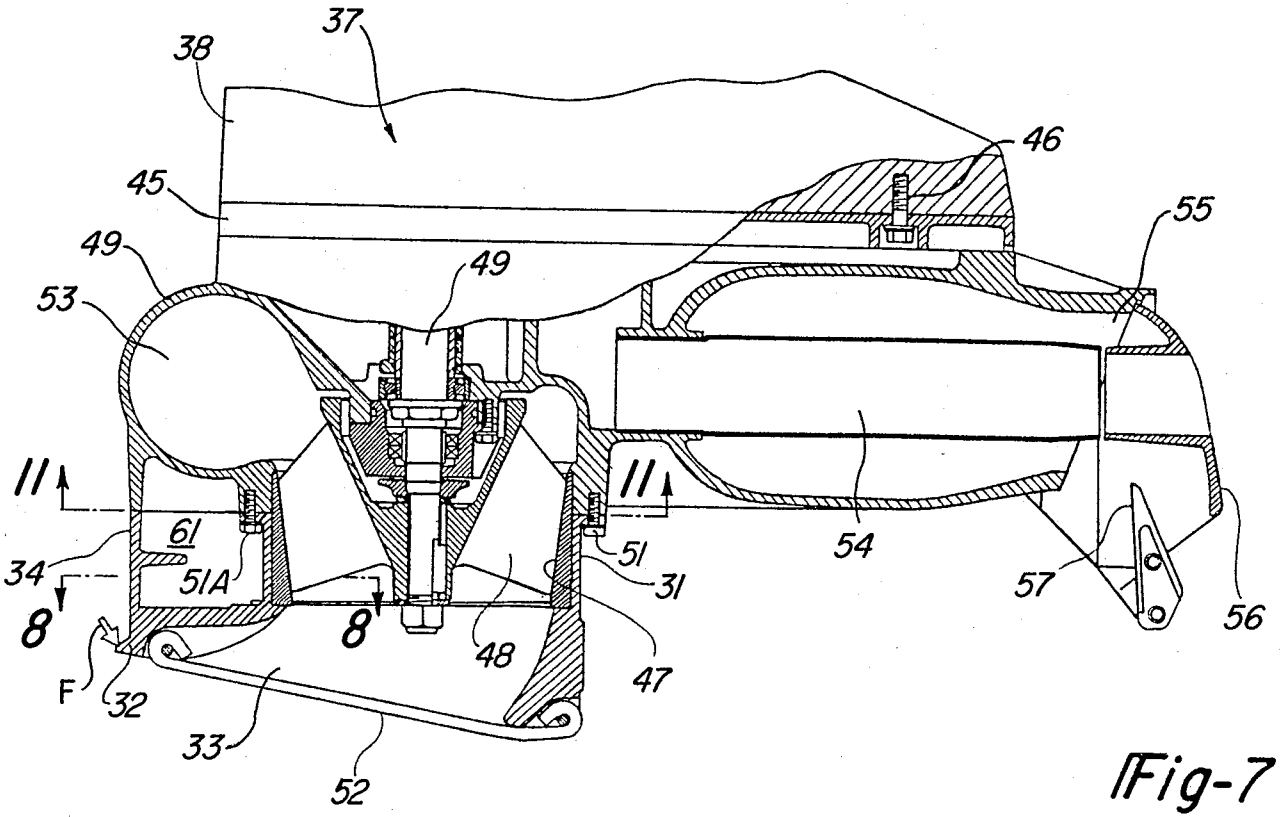
FIG. 7 is the side elevational view, with a portion broken away to show the configuration of the internal components.

Referring now additionally to FIGS. 6 and 7, the jet propulsion unit 39 is comprised of an outer housing assembly that is affixed to a spacer plate 45 that is carried by the lower portion of the drive shaft housing outer housing 38 by means of a plurality of threaded fasteners 46. Fasteners 50 connect the lower unit housing to the spacer plate 45. The outer housing is comprised of a plurality of interconnected members, as to be described, which includes an insert that forms an impeller chamber 47. An impeller 48 is received within the impeller chamber 47 and is affixed to the lower end of the drive shaft which appears in FIG. 7 and is identified by the reference numeral 49.

The foot like inlet portion 32 which defines the water inlet 33 is affixed to a main lower unit housing 49 by means of threaded fasteners 51. A screen 52 is positioned across the water inlet 33 so as to prevent the ingestion of large articles and foreign matter.

Water which has been drawn through the inlet 33 by the impeller 48 is discharged into a volute chamber 53 for discharge rearwardly through a rearwardly facing discharge nozzle 54. The discharge nozzle 54 extends through an injection outlet 55 for rearward discharge of the water to create the jet propulsion action for driving the watercraft forwardly.

A reversing bucket 56 is pivotally supported relative to the outlet 55 on a bracket assembly 57 for reversing operation. A linkage assembly 58 is connected to the reversing bucket 56 in a known manner so as to effect reverse thrust, as is well known in this art.

Figure 9:
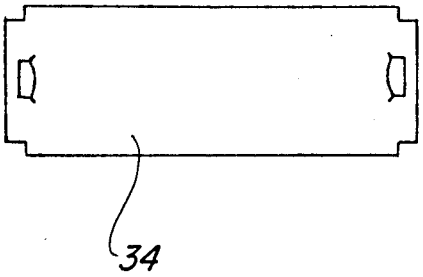
FIG. 9 is a front elevational view of the water deflector shown in FIG. 8.
Figure 10:
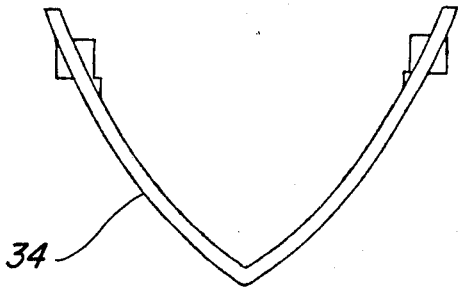
FIG. 10 is a top plan view of the water deflector.
Figure 11:
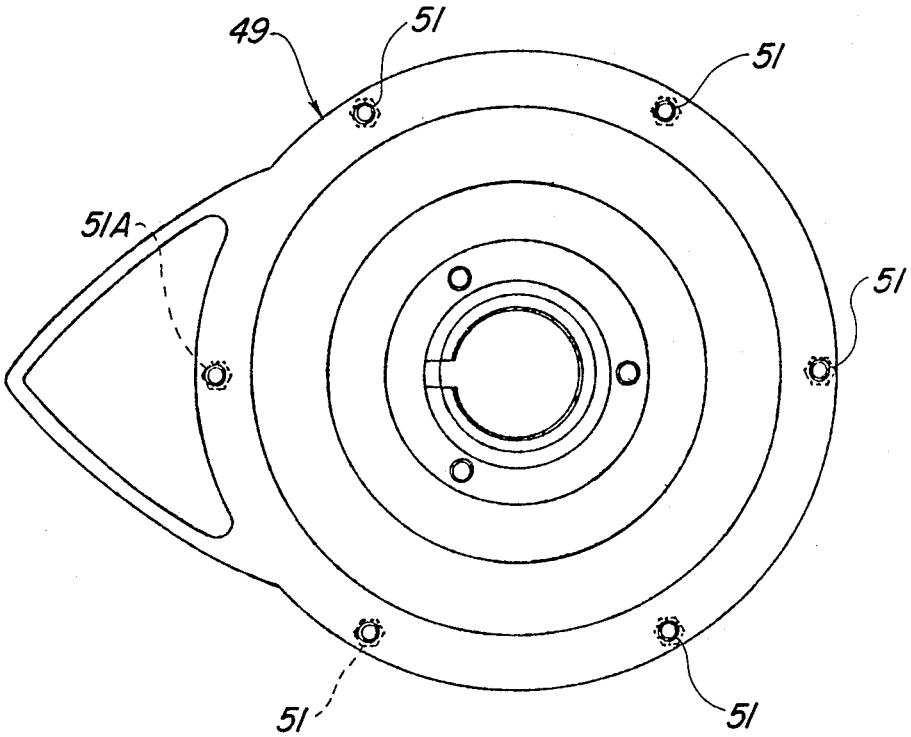
FIG. 11 is a cross-sectional view taken along the line 11—11 of FIG. 7.

As has been previously noted, the water deflection member 34 is affixed in overlying relationship to the housing portion 31. As may be seen in FIGS. 9 and 10, the deflecting member 34 has a generally V type streamline shape and is affixed in position by means of threaded fasteners 59 that are threaded into opposing faces of the lower unit housing portion 31. As a result, there is provided a cavity 61 that extends forwardly over the water inlet foot 31 so as to provide the aforenoted streamlining effect. There is an advantage to using the separate member 34, because if this member were formed integrally with the housing portion 31, the front fastener 51A could not be employed and, hence, the forward portion of the lower unit housing piece 31 would be unattached, an undesirable situation. It should be noted that the front fastener 51A is important in the event underwater objects are impacted so as to insure good attachment and resistance to separation under this condition.

It should be readily apparent from the foregoing description that the described construction provides good streamlining and still facilitates assembly and disassembly of the lower unit of the outboard drive. It is to be understood that the foregoing is a description of a preferred embodiment of the invention and that various changes and modifications may be made without departing from the spirit and scope of the invention, as defined by the appended claims.

We claim:

1. A jet propulsion unit for an outboard drive comprising a lower unit housing having a cylindrical portion journaling an impeller shaft for rotation about a vertically extending axis, an impeller contained within a generally cylindrical cavity in said cylindrical portion of said lower unit housing and affixed for rotation with said impeller shaft, an inlet portion depending from said cylindrical portion and defined in part by a foot portion extending forwardly therefrom and terminating in a forward end with said inlet portion extending forwardly of said cylindrical portion, a volute chamber formed above said cylindrical cavity and forming a rearwardly directed water outlet, and means forming a forwardly extending flow diverting member extending upwardly from said foot portion and forwardly from the sides of said cylindrical portion and terminating in proximity to the forward end of said foot portion.

2. A jet propulsion unit as set forth in claim 1 wherein the flow diverting member comprises a separate member affixed to the lower unit housing.

3. A jet propulsion unit as set forth in claim 2 wherein the lower unit housing comprises interconnected members and fastening means holding said interconnected members together, at least one of said fastening means being concealed within the flow diverting member when the flow diverting member is in place.

* * * * *